United States Patent [19]

Gässler et al.

[11] Patent Number: 4,491,113

[45] Date of Patent: Jan. 1, 1985

[54] CURRENT REGULATOR FOR AN ELECTROMAGNETIC CONSUMER FOR USE WITH INTERNAL COMBUSTION ENGINE CONTROL

[75] Inventors: Hermann Gässler, Vaihingen; Eugen Joos, Löchgau; Werner Jundt, Ludwigsburg; Hans Kubach, Korntal; Erich Singer, Besigheim, all of Fed. Rep. of Germany

[73] Assignee: Robert Bosch GmbH, Stuttgart, Fed. Rep. of Germany

[21] Appl. No.: 415,952

[22] Filed: Sep. 8, 1982

[30] Foreign Application Priority Data

Apr. 17, 1982 [DE] Fed. Rep. of Germany ..... 3214195

[51] Int. Cl.[3] ..... F02D 5/00

[52] U.S. Cl. ..... 123/490; 123/325; 123/482; 123/493; 361/152

[58] Field of Search ..... 123/490, 482, 491, 493, 123/325, 326, 458; 361/152

[56] References Cited

U.S. PATENT DOCUMENTS

| | | | |
|---|---|---|---|
| 3,465,731 | 9/1969 | Bassot et al. | 123/490 |
| 3,570,460 | 3/1971 | Rabus | 123/493 |
| 3,981,288 | 9/1976 | Wessel | 123/482 |
| 4,154,198 | 5/1979 | Hoshi | 123/490 |
| 4,180,026 | 12/1979 | Schulzke et al. | 123/490 |
| 4,300,508 | 11/1981 | Streit et al. | 123/490 |
| 4,354,472 | 10/1982 | Knapp et al. | 123/493 |

*Primary Examiner*—Andrew M. Dolinar
*Attorney, Agent, or Firm*—Edwin E. Greigg

[57] ABSTRACT

A current regulator is proposed for use in an electronically controlled, continuously operating gasoline injection system, with the aid of which a control element can be supplied with different current values depending upon the operating states of the engine. In addition to a current regulating phase during active operation, it is possible with the proposed current regulator to reverse the direction of current flow in the control element for the sake of blocking the supply of fuel during overrunning. Towards this end a circuit apparatus links signals relating to rpm, throttle valve position and temperature. Furthermore two safety circuit arrangements are proposed for the current regulator, so that in case of a failure of important components there is no impairment of safety, and emergency operation is assured.

9 Claims, 4 Drawing Figures

CURRENT REGULATOR FOR AN ELECTROMAGNETIC CONSUMER FOR USE WITH INTERNAL COMBUSTION ENGINE CONTROL

BACKGROUND OF THE INVENTION

The invention is based on a current regulator for an electromagnetic consumer used with a means of internal combustion engine control as generally defined hereinafter. German Offenlegungsschrift No. 21 32 717 discloses a trigger circuit for magnetic valves having a series circuit comprising a measuring resistor and a transistor, serving as the current control device, in series with the magnetic winding of an injection valve. The circuit apparatus disclosed there serves to provide a relatively high current at the beginning of an actuation pulse for the magnetic valve, and to regulate the so-called maintenance current to a lower level during the maintenance phase of the magnetic valve which follows the attracting phase. In order to realize this regulating process, the voltage drop across the measuring resistor is detected and compared with a set-point value. At the end of the desired injection pulse, the current through the magnetic valve is reduced to zero in the known circuit apparatus at the end of desired injection pulse. In connection with continuous-operation gasoline injection systems, German Offenlegungsschrift No. 24 37 713 discloses a clocked electromagnetic valve, which can be switched on and off in accordance with correction variables having different duty factors. However, this German Offenlegungsschrift No. 24 37 713 does not disclose a means of current regulation.

OBJECT AND SUMMARY OF THE INVENTION

The current regulator according to the invention for use with an internal combustion engine control permits a precise regulation of the current through the electromagnetic consumer, and when it is used together with a fuel injection system it permits extremely precise fuel metering.

A further object of the invention provides for faster and more reliable shutoff of the fuel supply during overrunning.

Another object of the invention is to provide for monitoring the mode of operation of the current regulator and the circuitry.

The invention will be better understood and further objects and advantages thereof will become more apparent form the ensuing detailed description of preferred embodiments taken in conjunction with the drawings.

DESCRIPTION OF THE EXEMPLARY EMBODIMENTS

The exemplary embodiments relate to a circuit apparatus for the supplementary control of the fuel quantity in a continuous-operation fuel metering system. The electromagnetic consumer controls the fuel pressure, which in the final analysis determines the metered fuel quantity in the continuously operating injection valves and, by way of the exemplary embodiments, is an electrohydraulic final control element in the fuel metering system.

Figure 1:
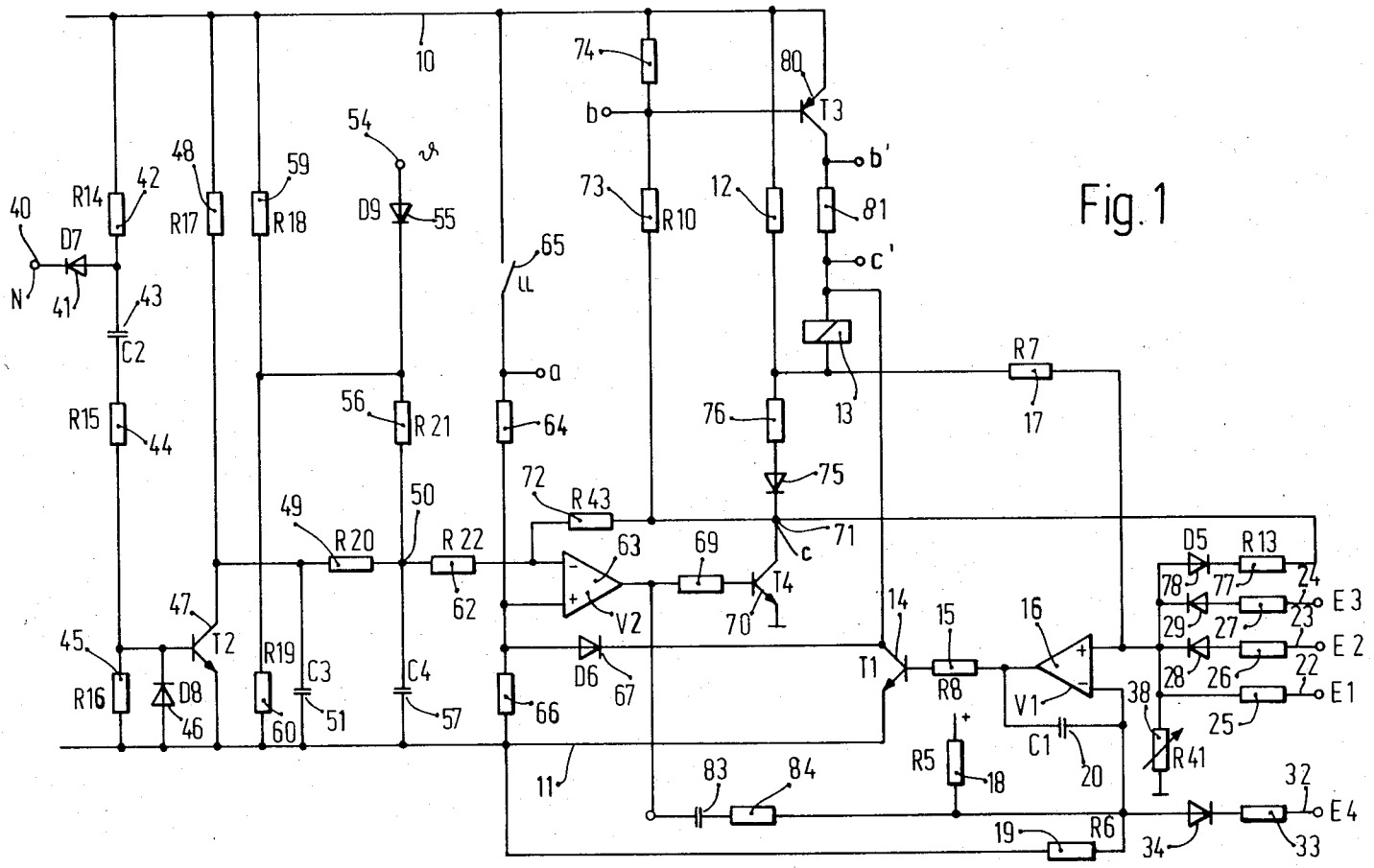
FIG. 1 is a detailed circuit diagram of a current regulator having specific circuits for shutoff of the fuel supply during overrunning.

FIG. 1 shows a series circuit, between a positive line 10 and a negative line 11, comprising a measuring resistor 12, an electrohydraulic control element 13 and a transistor 14 as the control device. The base of the transistor 14 is connected via a resistor 15 to the output of a differential amplifier 16, the positive input of which is coupled via a resistor 17 with the connecting point of the control element 13 and the measuring resistor 12. A comparison voltage is applied to the negative input of the amplifier 16, this voltage being determined, among other factors, by the ratio between two resistors 18 and 19 between the battery voltage lines 10 and 11. A capacitor 20 causes the differential amplifier 16 to function as an integrator.

The current is variable by means of the control element 13 via signals at the inputs E1 through E3, which are numbered 22, 23, and 24. The input 22 is connected via a resistor 25 with the positive input of the amplifier 16, while the inputs 23 and 24 are also connected with the positive input of the amplifier 16, via respective series circuits comprising resistors 26 and 27 and diodes 28 and 29, respectively. A further signal input E4 is numbered 32, and it is coupled via a resistor 33 and a diode 34 to the negative input of the differential amplifier 16.

The basic structure of the circuit layout shown in FIG. 1 functions as follows:

In accordance with various input signals at the connection points E1 through E3, 22–24, a current is generated through the control element 13. A comparison voltage is formed through the resistors 18 and 19. The potential at the positive input of the amplifier 16 corresponds, during normal operation, to the value of the comparison voltage located at the negative input. If the signal at one of the inputs 22–24 is raised via the potential at the negative input of the amplifier 16, then the signal at the positive input of the amplifier 16 increases as well, and its output signal increases. As a result, the current through the transistor 14 increases as well. This increased current effects a greater voltage drop at the measuring resistor 12, which has the effect of an inverse coupling of the differential amplifier 16. With the aid of the resistor 38, which is connected from the positive input to ground, a basic current through the control element 13 can be established. This current is equal to zero, in systems which provide solely an increase in fuel metering but do not provide for leaning of the mixture. In systems with leaning of the mixture, a positive basic current is applied. By dropping the potential at one of the inputs 22–24, the current through the control element 13 is reduced as well.

By connecting the input E4, that is the connection 32, to ground potential a current of arbitrary intensity can be established, depending upon the dimensions of the resistor 33. For instance, E4 may be connected with a starting signal transducer, in which case an increase in fuel quantity for starting is then effective during the period of actuation of the starting switch.

What is important is that the signals at the inputs E1 through E3, 22–24 may be either continuous or clocked, and the current through the control element 13 then takes a corresponding course. In the case where it is triggered in a clock manner, the clock frequency should be selected high enough so that the final control element itself, because of its sluggishness, is not capable of following up the clock signal.

The remaining circuitry of the current regulator shown in FIG. 1 relates to the control of the control element 13 during engine overrunning. In this case, a reversal of the current through the control element 13 should be effected, which serves the purpose of reliably shutting off the supply of fuel.

One input 40 for an rpm signal is followed by a diode 41. A series circuit comprising a resistor 42, a capacitor 43, and two resistors 44 and 45 is located between the battery voltage lines 10 and 11. The diode 41 is connected to the connecting point of the resistor 42 and the capacitor 43. Parallel to the resistor 45 are a diode 46 and the base-emitter path of a transistor 47. The collector of this transistor is coupled via a resistor 48 with the positive line 10 and via a resistor 49 with a summing point 50. A capacitor 51 bypasses the transistor 47. A temperature-dependent signal travels from a connection point 54 via a diode 55 and a resistor 56 to the summing point 50, and a further capacitor 57 is located between the summing point 50 and the ground line 11. A voltage divider comprising two resistors 59 and 60, located between the battery voltage connections 10 and 11, supplies a constant potential to the connecting point of the diode 55 and the resistor 56. The summing point 50 is connected via a resistor 62 with the negative input of an operational amplifier 63. Its positive input is connected first, via a series circuit of a resistor 64 and an idling switch 65, with the positive line 10, and furthermore, via a resistor 66, with the negative line 11 and via a diode 67 with the collector of the transistor 14. Its output is carried via a resistor 69 to the base of a transistor 70 connected on its emitter side to ground. The collector of this transistor, in turn, is connected with a summing point 71, from whence a resistor 72 is connected to the negative input of the operational amplifier 63, and a series circuit of two resistors 73 and 74 is carried to the positive line 10, a series circuit comprising a diode 75 and a resistor 76 furnishes a connection with the measuring resistor 12, and finally a circuit comprising a resistor 77 and a diode 78 additionally determines the signal at the positive input of the amplifier 16. The base of a transistor 80 located on its emitter side at the positive line 10 is connected to the connecting point of the two resistors 73 and 74, and the collector of this transistor 80 is coupled via a resistor 81 with the connecting point of the control element 13 and the transistor 14. Finally, there is a further connection between the output of the amplifier 63 and the connecting point of the two resistor 18 and 19 via a series circuit comprising a capacitor 83 and a resistor 84.

An rmp-dependent signal is present at the connection point 40. At the onset of the positive amplitude of this signal, the diode 41 blocks, and the capacitor 43, previously discharged, is charged via the resistors 42 and 44 as well as the base-emitter path of the transistor 47. This transistor 47 becomes conductive and discharges the capacitor 51. After approximately 0.5 milliseconds, in a specialized circuit, the previously mentioned charging process of the capacitor 43 is terminated to the extent that the transistor 47 once again blocks and the capacitor 51 is charged via the resistor 48. The course of the voltage across the capacitor 51, because of the low-pass filter including the resistor 49 and the capacitor 57, undergoes smoothing. What is of importance is that the average voltage values at the capacitor 57 becomes smaller as the rpm increases.

If the switch 65 (idling switch) is now closed at a relatively high rpm ($n_{ab}$), then the condition of overrunning prevails, and the voltage at the inverting input of the amplifier 63 is below the comparison voltage at the noninverting input. The amplifier 63 thus switches its output potential to a high value, and as a result the transistors 70 and 80 become conductive. At the same time, the positive input of the amplifier 16 is also connected to ground via the resistor 77 and the diode 78, so that the transistor 14 blocks. As a result, a reversal of the current direction occurs in the control element 13, because a conductive connection now exists from the positive line 10 via the transistor 80, the resistor 81, the control element 13, the series circuit comprising the resistor 76 and the diode 75 and the transistor 70.

With decreasing rpm, the voltage across the capacitor 57 again falls below the comparison voltage applied to the positive input of the amplifier 63, so that the original signal behavior with the current regulator is again provided—having, among others, the characteristics of the measuring resistor 12, the control element 13, and the transistor 14. Because of the direct coupling via the resistor 72, the circuit apparatus has a hysteresis; in other words, the cutoff rpm $n_{ab}$ is always above the resumption rpm $n_{we}$.

Figure 2:
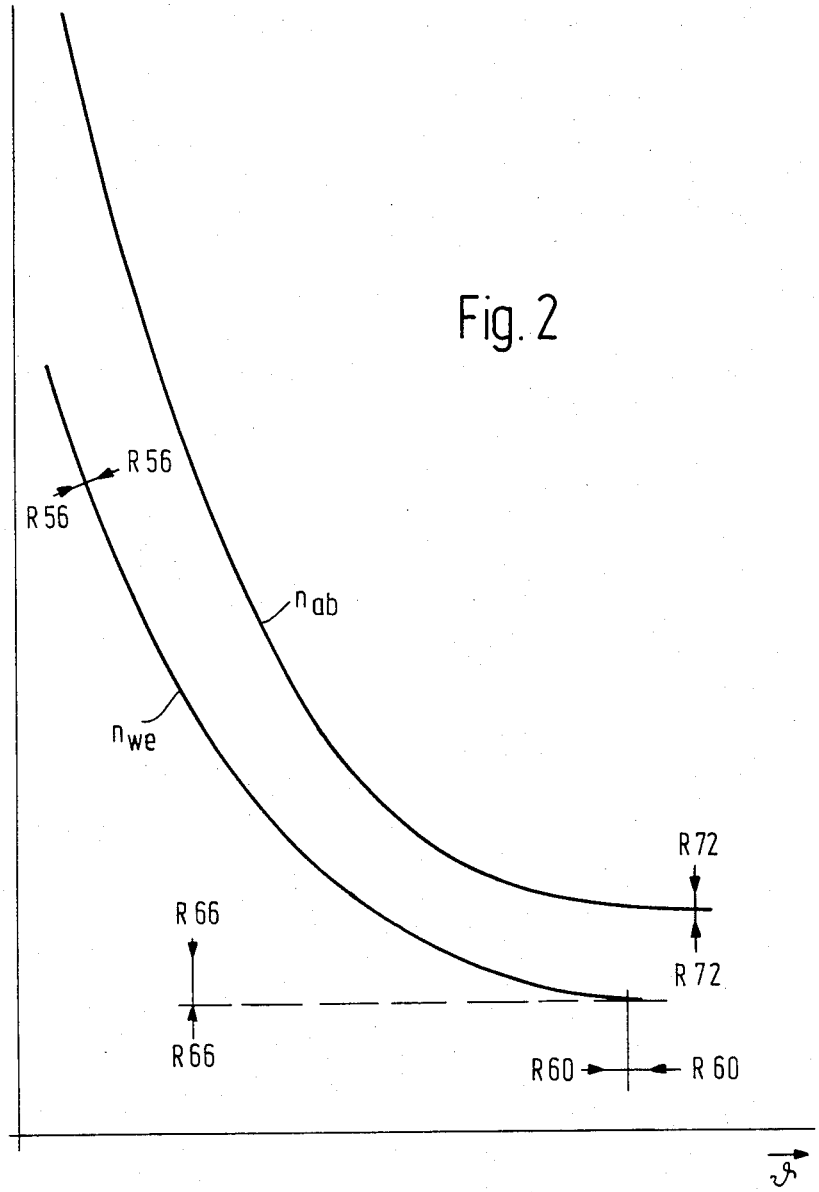
FIG. 2 is a signal diagram explaining the mode of operation of the circuit apparatus during overrunning.

The network having the resistors 59, 60 and 56 as well as the diode 55 determines the influence of temperature upon the behavior of the circuit apparatus during overrunning. The resistors 59 and 60 provide a temperature threshold, and the resistor 56 determines the magnitude of the influence of temperature. The resumption rpm $n_{we}$ is established at high temperature values with the resistor 66. This temperature influence on the rpm thresholds for cutoff and resumption are shown in FIG. 2. It can be seen from the drawing that the individual rpm values are higher, the lower the temperature is. Also shown in FIG. 2 are the effects of variously dimensioning the components by way of which, in a predetermined engine temperature range, a desired temperature-dependent curve of the overrunning cutoff rpm and the resumption rpm is obtained.

In the case of a defect in the circuit of FIG. 1, for instance if there is through-alloying (alloy diffusion) in the transistors 47, 70 causing a short to ground on the part of the capacitors 43, 51 and 57, then it is possible for a continuous shutoff of the fuel supply to occur because in that case overrunning is stimulated continously. This case is very critical because the engine behavior is adjusted accordingly and the engine can no longer be started. Two possibilities for monitoring the circuitry will therefore be discussed below.

Figure 3:
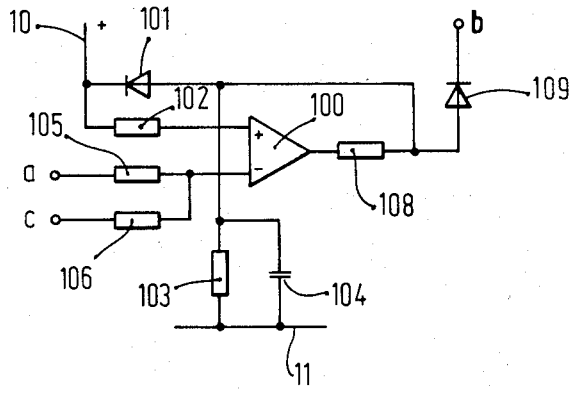
FIGS. 3 and 4 illustrate auxiliary circuits for monitoring the specific mode of operation of the circuit apparatus shown in FIG. 1.

First possibility (FIG. 3):

A basic condition for blocking the fuel supply in overrunning is a closed idling switch 65. The underlying concept of the subject of FIG. 3 is the linkage in an additive manner of the potential at the output of the switch 65 to the potential at the collector of the transistor 70. The circuitry of FIG. 3 has a operational amplifier 100, the positive output of which is connected via a parallel circuit of a diode 101 and a resistor 102 to the positive line 10 and via a parallel circuit of a resistor 103 and a capacitor 104 to the ground line 11. Two resistors 105, 106 lead respectively from the negative input of the amplifier 100 to the connecting point "a" of switch 65 and resistor 64 and to the linkage point 71 serving a connection point "c". On the output side, the amplifier 100 is connected (connection b) via a resistor 108 and a diode 109 with the base of the transistor 80. Finally, the amplifier 100 also has a direct coupling which also encompses the resistor 108 on the output side.

If the impermissible case exists that while the switch 65 is opened, that is while there is low potential at the connection "a", the transistor 70 is switched through as well so that low potential also prevails at the linkage point 71 (c), then the output of the operational amplifier 100 of FIG. 3 jumps to a high value and blocks the transistor 80. To prevent this blocking from ocurring in an unintended manner when the device is switched on, the voltage increase at the positive input of the operational amplifier 100 is retarded by the capacitor 104. The diode 101 protects the base-emitter path of the transistor 80. Upon the occurrance of this impermissible case described above, the control element 13 is excited in neither one direction nor the other, because both the transitor 14 and the transistor 80 are blocked. In this example, the design of the fuel metering system must accordingly be such that in the non-excited state of the control element 13, an at least emergency operation is still possible.

Figure 4:
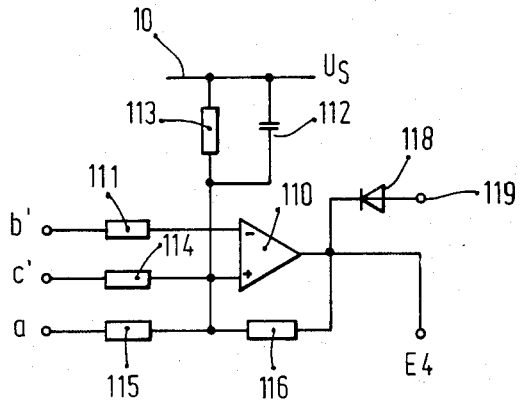

Second Possibility (FIG. 4):

With the circuitry shown in FIG. 3, the transistor 80 cannot be secured. FIG. 4 therefore shows a possible circuit with which this case can also be taken into consideration. The design, in detail, is as follows. The negative input of an operational amplifier 110 is connected via resistor 111 with the collector of the transistor 80 (connection point b'). The positive input is connected first via a parallel circuit of a resistor 112 and a capacitor 113 with the positive line 10 and furthermore, via respective resistors 114 and 115, with the connecting point of the resistor 81 and the control element 13 as well as with the connecting point of the switch 65 and resistor 64 (see connecting points c' and a). The operational amplifier 110 is directly coupled by means of a resistor 116. On the output side it is connected with the connection point 32 of FIG. 1 and furthermore via a diode 118 with a connecting point 119 which can be influenced in accordance with need.

The resistors 76, 81, 112, 111, 114 and 115 are designed such that when there is a flow of current through the resistor 81 and the switch 65 is opened, the potential resulting at the positive input of the operational amplifier 110 falls below the potential at the negative input thereof. As a result, the output potential of the operational amplifier 110 jumps to a low value and the transistor 70 is blocked via the diode 34. The hysteresis, determined by the resistor 116, is designed to be so great that even when the idling switch 65 is closed, the transistor 70 can no longer become conductive. As a result it is assured that in the case of a through-alloyed or in other words continuously conductive transistor 80 and a closed idling switch as well as at low rpm, there will be no cutoff of the fuel supply.

If the transistor 80 has become through-alloyed and if the transistor 14 is triggered (the latter transistor determines the magnitude of enrichment in the exemplary embodiment under discussion), it is possible for the transistor 14 to be overloaded by the high additional current through the transistor 80 and itself become through-alloyed. This could cause a continuously high enrichment current through the control element, which under some circumstances may cause the engine to die because of an excessive enrichment of the gasoline-air mixture. For this reason, the comparison value at a connection point 119 may be so greatly reduced via the diode 118 that no further enrichment can take place. By means of this intervention, the circuit apparatus is then put completely out of operation; however, because of the emergency operation characteristics of the mechanically continuous injection the engine continues to operate.

In a further embodiment, the two protection circuits shown in FIGS. 3 and 4 may also be combined with one another.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A current regulator for an electromagnetic consumer of an internal combustion engine control means having a measuring resistor and a current control device in series with said consumer, comprising, a differential amplifier coupled with said current control device and having at its positive input means responsive to control variables and to a signal from said measuring resistor, and at its negative input means responsive to a controllable comparison signal, and wherein said differential amplifier includes means connected thereto so as to form an integrator therewith.

2. A current regulator as defined by claim 1, wherein said electromagnetic consumer is an electromagnetic control element for fuel metering in said internal combustion engine.

3. A current regulator as defined by claim 2, wherein said control element controls fuel metering in a continuously operating gasoline injection system.

4. A current regulator as defined by claim 2, further comprising, a circuit means for adjusting to a zero fuel quantity said electromagnetic control element during overrunning.

5. A current regulator as defined by claim 1, further comprising, a switching means for reversing the current direction in said consumer.

6. A current regulator as defined by claim 5, wherein said switching means comprises a pair of electronic switching means responsive to operating voltages and each one of said pair connected at one of either side of said electromagnetic consumer.

7. A current regulator as defined by claim 6, further comprising, a circuit apparatus having an amplifier coupled to said electronic switching means for processing signals relating to the rpm, and an idling switch for controlling the supply of fuel during overrunning.

8. A current regulator as defined by claim 6, further comprising an idling switch, wherein the signals from one of said pair of switching means are linked with said idling switch via a control means in an additive manner, and in the case of equal potential values thereof, said signals define an impermissible operating condition, whereby the electromagnetic consumer is controlled such that no current flows therethrough.

9. A current regulator as defined by claim 8, wherein said idling switch and said pair of switching means block said current control device.

* * * * *